US011253081B2

(12) United States Patent
Song et al.

(10) Patent No.: US 11,253,081 B2
(45) Date of Patent: Feb. 22, 2022

(54) CHAIR WITH REMOVABLE SIDE BARRIERS

(71) Applicant: B&G Technology Co., Ltd., Guangdong (CN)

(72) Inventors: Bin Song, Guangdong (CN); Runxiang Guo, Guangdong (CN)

(73) Assignee: B&G Technology Co., Ltd., Foshan (CN)

( * ) Notice: Subject to any disclaimer, the term of this patent is extended or adjusted under 35 U.S.C. 154(b) by 0 days.

(21) Appl. No.: 16/487,175

(22) PCT Filed: Jun. 6, 2018

(86) PCT No.: PCT/CN2018/090122

§ 371 (c)(1),
(2) Date: Aug. 20, 2019

(87) PCT Pub. No.: WO2019/109616

PCT Pub. Date: Jun. 13, 2019

(65) Prior Publication Data

US 2020/0288876 A1 Sep. 17, 2020

(30) Foreign Application Priority Data

Dec. 7, 2017 (CN) ..... 201721719263.3

(51) Int. Cl.
*A47C 31/11* (2006.01)
*A47C 7/54* (2006.01)

(52) U.S. Cl.
CPC ..... *A47C 31/11* (2013.01); *A47C 7/54* (2013.01)

(58) Field of Classification Search
CPC A47C 31/11; A47C 7/624; A47C 4/28; A47C 4/283; A47C 4/30; A47C 7/54
See application file for complete search history.

(56) References Cited

U.S. PATENT DOCUMENTS 909,411 A * 1/1909 Hockney ..... A47C 4/283 297/45
1,934,615 A * 11/1933 Selverstone ..... A47C 31/11 297/229

(Continued)

FOREIGN PATENT DOCUMENTS

CN 202489566 10/2012
CN 202941706 5/2013

(Continued)

OTHER PUBLICATIONS

International SearchReport forPCT/CN2018/090122, dated Sep. 5, 2018.
Written Opinion for PCT/CN2018/090122.

*Primary Examiner* — David R Dunn
*Assistant Examiner* — Tania Abraham
(74) *Attorney, Agent, or Firm* — Nixon Peabody LLP

(57) ABSTRACT

System (200) is provided for a chair with removable armrests. The system (200) includes a chair back (220) connected to a rectangular chair seat (210) with chair feet (230) and two handrails (240). The handrails (240) are connected to the chair back (220) and the rectangular chair seat (210). The chair seat (210) further comprises a chair frame (260), a seat cushion (270) and two side wall clothes (250), wherein each side wall cloth (250) is configured to optionally secure the side wall cloth (250) to a respective handrail (240). The side wall cloth (250) can secure itself to a handrail (240) through an internal adhesive on an internal side of the side wall cloth (250) and an external adhesive of an external side of the side wall cloth (250). The side wall cloth (250) can optionally be secured to the handrail (240) by wrapping around the handrail (240) and connecting the internal and external adhesives.

5 Claims, 6 Drawing Sheets

(56) References Cited

U.S. PATENT DOCUMENTS 2,080,761 A * 5/1937 Crawford ..... A47C 4/30 297/452.13
2,254,466 A * 9/1941 Albert ..... A47D 1/0085 297/225
2,725,096 A * 11/1955 Granby ..... A47C 4/30 297/452.13
3,779,599 A * 12/1973 Gottfried ..... B60N 2/2827 297/253
4,518,198 A * 5/1985 Daniels ..... A45C 9/00 206/216
5,476,308 A * 12/1995 St. Germain ..... A47C 5/06 297/229
D383,636 S * 9/1997 Harris ..... D6/333
6,428,098 B1 * 8/2002 Allbaugh ..... A47D 1/00 297/219.12
6,485,100 B1 * 11/2002 Hitt ..... A47C 7/18 297/219.1
8,950,807 B2 * 2/2015 Lerm ..... A47C 31/006 297/219.12
9,681,764 B1 * 6/2017 Boynton ..... A47G 9/066
9,986,847 B2 * 6/2018 Tanaka ..... A47C 7/54
2009/0189423 A1 7/2009 Chi
2010/0140994 A1 * 6/2010 Moore ..... A47C 31/11 297/227
2013/0328362 A1 * 12/2013 Miller ..... A47C 7/622 297/188.2
2014/0070575 A1 * 3/2014 von Saher ..... A47C 31/11 297/188.2
2014/0223666 A1 * 8/2014 Pavlin ..... A61G 5/10 5/727
2017/0332802 A1 * 11/2017 Stern ..... A47C 7/546

FOREIGN PATENT DOCUMENTS

CN 203852097 10/2014
CN 204232661 4/2015
JP H-11-32863 2/1999
JP 3161374 4/2001
JP 2008-142501 6/2008

* cited by examiner

System 400

CHAIR WITH REMOVABLE SIDE BARRIERS

CROSS-REFERENCE TO RELATED APPLICATIONS

This application claims priority to and the benefit of Chinese Patent Application No. 201721719263.3, filed Dec. 7, 2017 and entitled "Chair with Removable Side Cloths". The contents of this application are hereby incorporated by reference in their entirety as if fully set forth herein.

FIELD OF THE INVENTION

The present invention relates to chair armrests, and more specifically to systems and methods for removing and modifying side wall cloths of chair armrests.

BACKGROUND

Armchairs have a wide spectrum of use among consumers. Consumers choose armchairs for a variety of reasons, including comfortability, style and design considerations, and size among other variables. Many consumers own a number of armchairs to accommodate their range of preferences.

Once an armchair is constructed, it has little ability to change its structure to meet the changing needs of a consumer. In particular, armrests of armchairs typically have two possible structures, either a railing armrest or a board armrest. Railing armrests can be affixed to the back of the chair and can leave open space between the seat of the chair and the railing armrest. Board armrests are typically affixed to the back of the chair and the seat of the chair to form a solid enclosure. Both railing and board armrests provide little flexibility because they are attached to the back of the chair and the chair seat. The armrests cannot be disassembled or moved and the style, appearance, or fabric design cannot be changed once the armchair has been constructed.

What is needed is an armrest which can accommodate changing size interests, which is easily detachable for cleaning, and which can be easily switched out with armrests of other designs or style considerations.

SUMMARY

The various examples of the present disclosure are directed towards a system for optionally connecting side wall cloths to armrests of an armchair. The system includes a chair back connected to a rectangular chair seat, four chair feet connected to the bottom of the rectangular chair seat, and two handrails connected to the chair back and the rectangular chair seat. The four chair feet can be connected to corners of the rectangular chair seat. The handrails can be connected to adjacent sides of the chair back and rectangular chair seat so that each handrail is opposite from the other handrails in the chair system. The rectangular chair seat can further comprise a chair frame, a seat cushion, and two side wall cloths. The side wall cloths can be connected to the seat cushion and configured to optionally secure the side wall cloth to a handrail.

In some implementations, each side wall cloth further comprises an internal adhesive on an internal side of the side wall cloth and an external adhesive on an external side of the side wall cloth. Each side wall cloth can be further configured so that each side wall cloth wraps around the respective handrail on one end and the chair frame on an opposing end and is secured in place by connecting the internal and external adhesives.

In some implementations, the two handrails can be cylindrical or cuboid elements having a perimeter of a set distance. The chair frame can also be a cylindrical or cuboid element having the same perimeter of the handrails. The internal and external adhesive elements can be separated by a distance which is the same set distance of the handrails and the chair frame.

The internal and external adhesive elements can be a sticker element, Velcro, zipper, snaps, hooks, tying elements, or any other mechanism configured to secure the side wall cloth to itself when wrapped around the handrail.

DETAILED DESCRIPTION

Figure 1A:
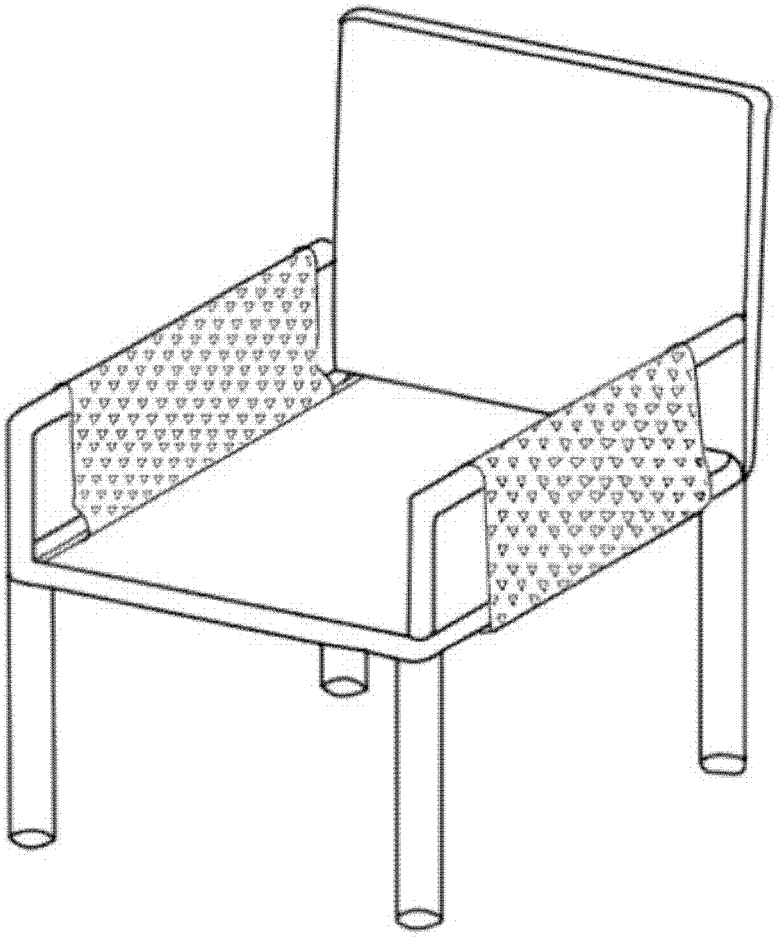
FIG. 1A shows a schematic diagram of a conventional chair system with a railing armrest.

The present invention is described with reference to the attached figures, wherein like reference numerals are used throughout the figures to designate similar or equivalent elements. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operations are not shown in detail to avoid obscuring the invention. The present invention is not limited by the illustrated ordering of acts or events, as some acts may occur in different orders and/or concurrently with other acts or events. Furthermore, not all illustrated acts or events are required to implement a methodology in accordance with the present invention.

The present disclosure provides a detachable chair armrest implemented by removable side wall cloths for each armrest. The removable side wall cloths include two adhesive elements attached to each end of the removable side wall cloths. These adhesive elements are separated by a distance wide enough to wrap around a handrail of the chair on one side and a chair frame on the other side. These removable side wall cloths can thus enclose the armrest space of a chair or be easily removed to allow open space.

Therefore, the removable nature of the cloths allows for easy modification of the structure of the armchair to suit the user's varying desires. Additionally, the side wall cloth as described can be low cost so users can choose a variety of colors and patterns to match and replace their armchairs or interior décor. This allows a level of flexibility to provide for the personalized needs of consumers.

FIG. 1A shows a conventional chair with railing armrests. The railings can be barriers configured to extend from the chair back to the chair seat while leaving an open space between the barrier and the chair seat. A consumer has no ability to change the structure of the open space between the armrests even if the consumer dislikes the open space between the railing and the chair seat.

Figure 1B:
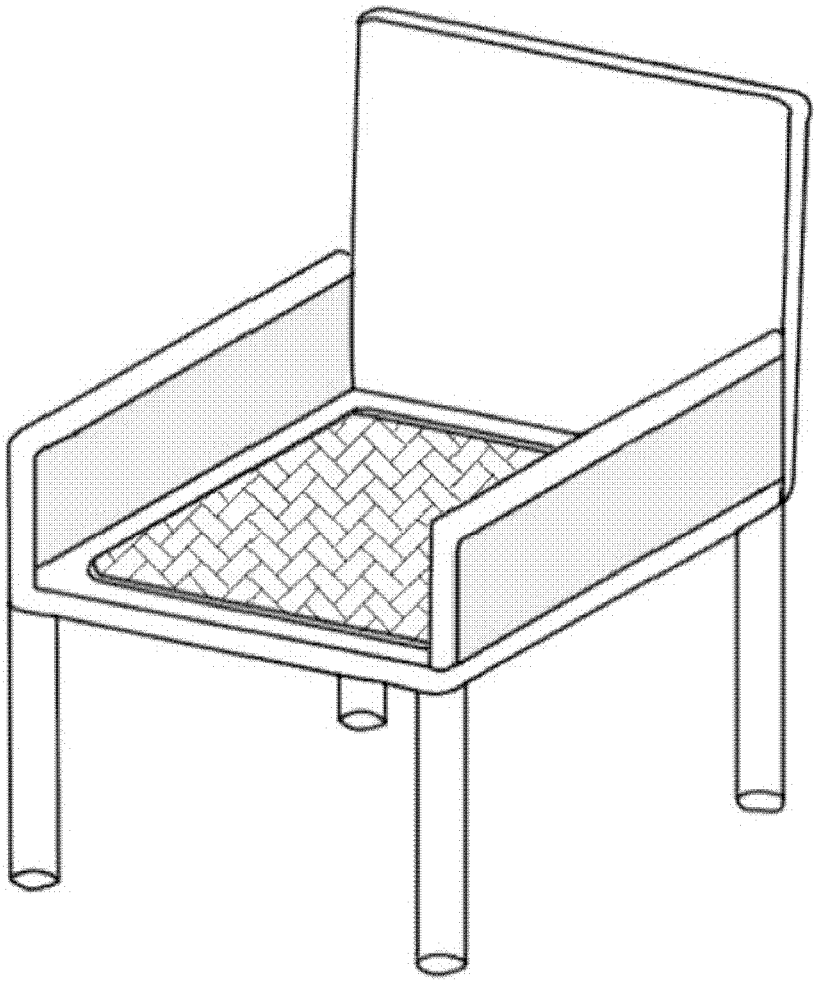
FIG. 1B shows a schematic diagram of a conventional chair system with a board armrest.

FIG. 1B shows a conventional chair with board armrests. The board armrests can be configured to extend from the chair back to the chair seat. The board armrests can be made from a variety of materials. However, just as in the chair system of FIG. 1A, a consumer who has a chair system as in FIG. 1B has no ability to change the structure of the armrests even if the consumer dislikes anything about the board armrests.

In both FIG. 1A and FIG. 1B, the consumer has no ability to change the style, appearance, or fabric design of the armchair.

Figure 2A:
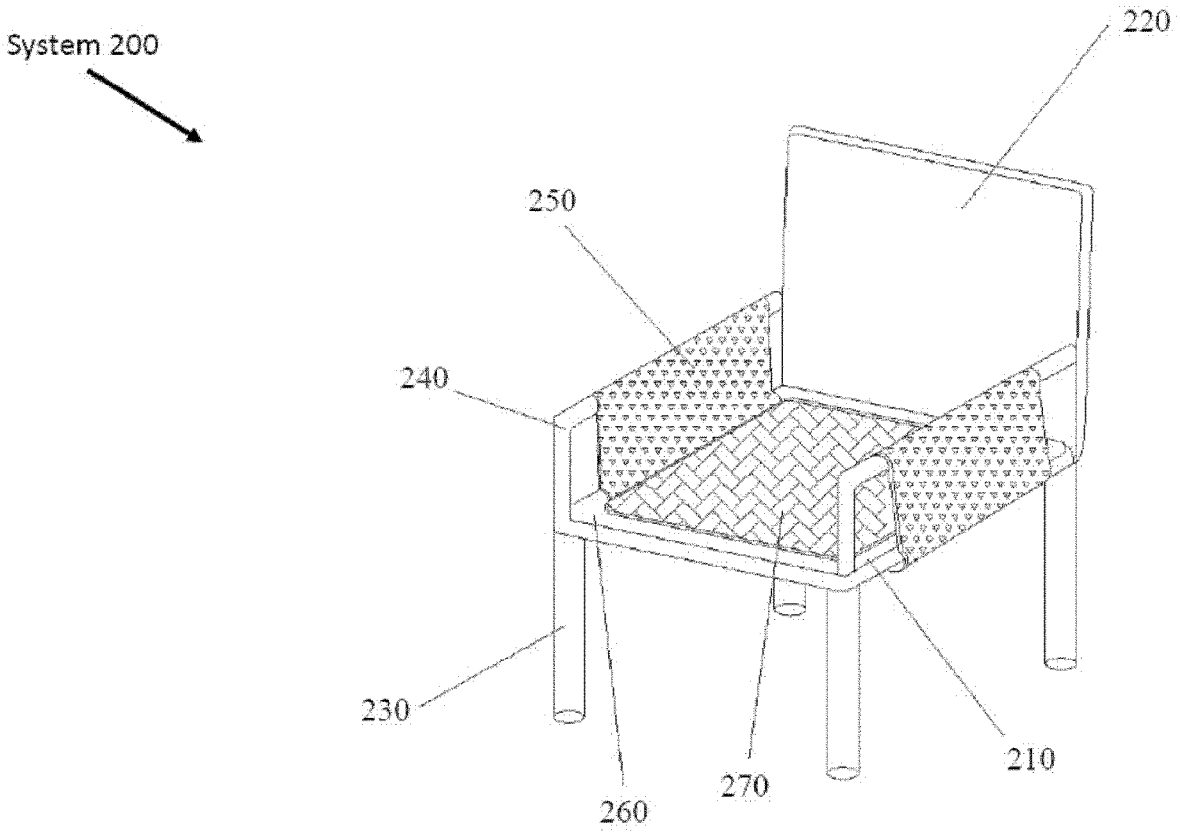
FIG. 2A shows a schematic diagram of an exemplary chair system according to an embodiment of the present disclosure with a removable chair seat connected to the chair system.

FIG. 2A shows an exemplary system 200 of a chair system according to an embodiment of the present disclosure. The system 200 includes a chair seat 210; a chair back 220; chair feet 230; handrails 240; a side cloth 250; a chair frame 260; and a chair cushion 270. The chair back 220 is configured to provide support for a consumer and is connected to the chair frame 260, the chair seat 210, the handrails 250, and (optionally) the chair feet 230. The chair feet 230 can also be connected directly to the chair frame 260. The chair feet 230 and the chair frame 260 can be configured to bear the weight of a user when a user sits on the chair seat 210.

A chair cushion 270 can be provided on top of the chair seat 210 to provide padding for the user. The chair cushion 270 can also be inlaid in the chair seat 210 so that the chair cushion lies flush with the chair seat 210 and the chair frame 260. The chair cushion 270 can be connected to side cloths 250 on either side of the chair cushion 270 such that the side cloths 260 are adjacent to the handrails 250. The handrails 240 and the chair frame 260 can be tubular elements such that they have a circumference of a set distance. The handrails 240 and the chair frame 260 can also be a cuboid form with a perimeter of a set distance. The handrails 240 and the chair frame 260 can have the same circumference or perimeter and they can also have different circumferences or perimeters.

The side cloths 250 can be configured to wrap around the handrails 240 and the chair frame 260. The side cloths 250 can be secured in place around the handrails 240 and the chair frame 260 by an adhesive element (discussed further with regards to FIG. 3).

FIG. 2A shows a desirable configuration of the armchair where the handrails 250 can be securely connected to the chair frame 260. This secure covering of the sides of the armchair can prevent items or limbs from passing between the chair frame 260 and the handrails 250. Additionally, the coverings provide comfortability for the user who can have fabric padding on the sides of the chair.

Figure 2B:
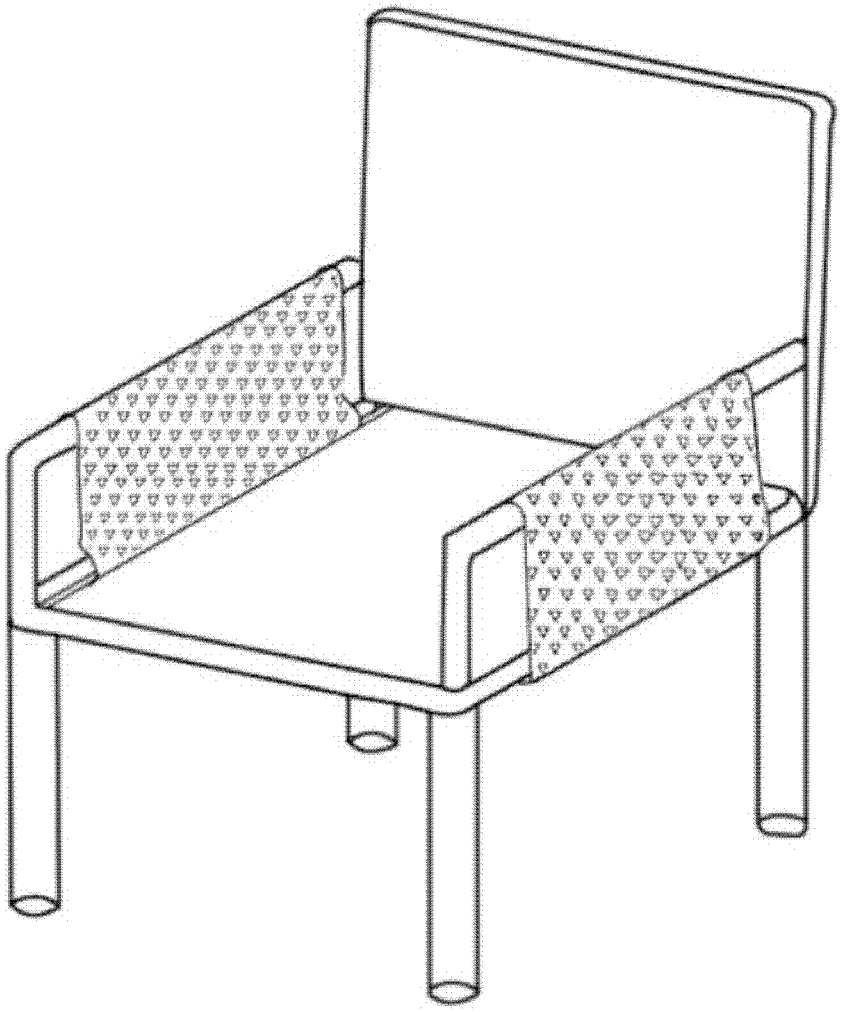
FIG. 2B shows a schematic diagram of an exemplary chair system according to an embodiment of the present disclosure without a removable chair seat but with a removeable side cloths.

FIG. 2B shows a schematic diagram of an exemplary chair system according to an embodiment of the present disclosure without a removable chair cushion 270. This shows that the chair system can be easily customizable to the consumer's needs and desires. The chair cushion 270 can be removed and the chair system 200 can still be fully usable.

Figure 2C:
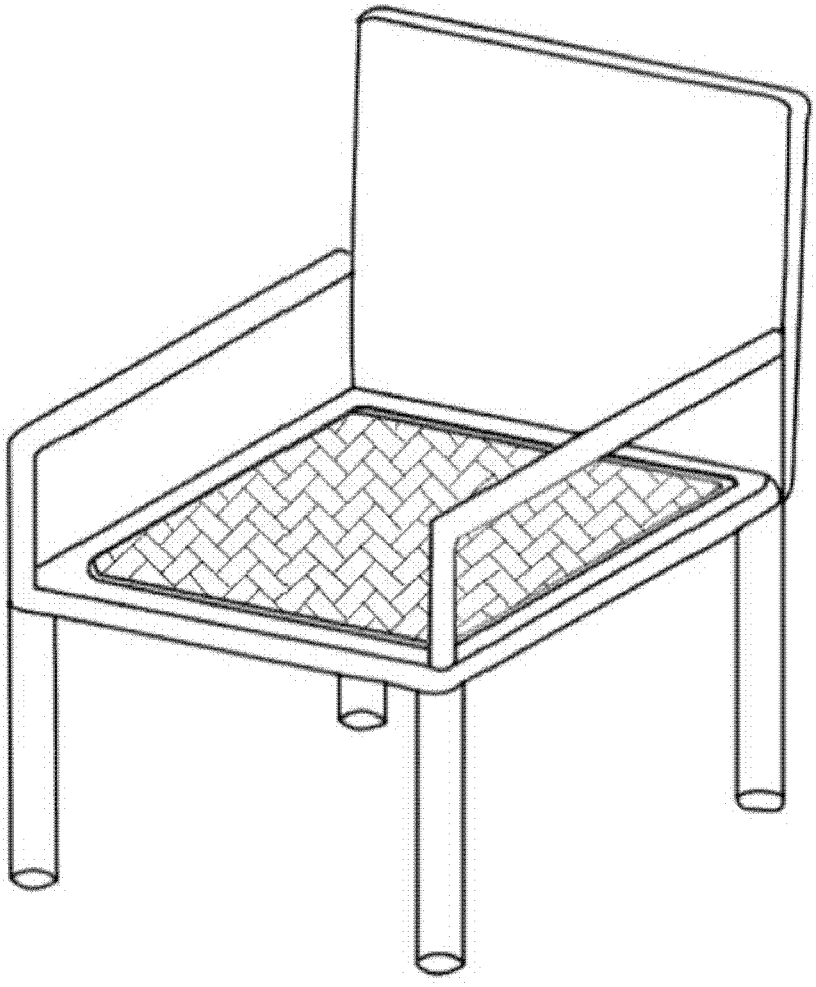
FIG. 2C shows a schematic diagram of an exemplary chair system according to an embodiment of the present disclosure with a removable chair cushion but without removeable side cloths.

FIG. 2C shows a schematic diagram of an exemplary chair system according to an embodiment of the present disclosure without removeable side cloths 250. This shows that the chair system can be easily customizable to the consumer's needs and desires. The removeable side cloths can be taken off and the chair can still be fully usable.

Figure 3:
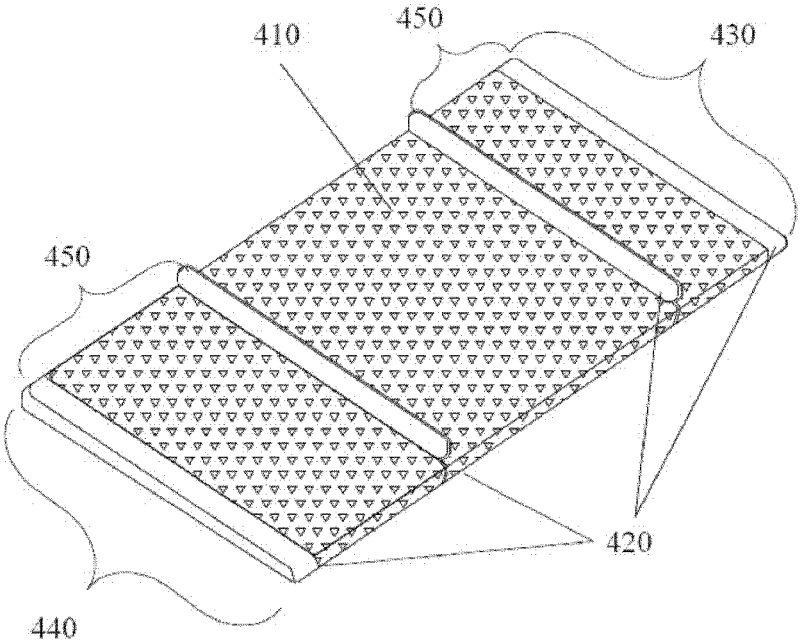
FIG. 3 shows a schematic diagram of an exemplary side cloth according to an embodiment of the present disclosure.

FIG. 3 shows an exemplary system 400 of a side wall cloth according to an embodiment of the present disclosure. The side wall cloth system 400 includes woven fabric 410; adhesive elements 420; a front end 430; a back end 440; and a fixed distance 450. The woven fabric 410 provides a base for the side wall cloth system 400 and a location onto which the adhesive elements 420 can be fixed. A pair of adhesive elements 420 can be affixed to the front end 430 and another pair can be affixed to the back end 440.

The adhesive elements 420 can be separated by a fixed distance 450. The fixed distance 450 can be wide enough to encircle or wrap around a stable element such as a handrail 240, a chair frame 260, or any other element of the chair configured to secure a cloth. The fixed distance 450 separating the pair of adhesive elements 420 at the front end 440 can be a different length than the fixed distance 450 separating the pair of adhesive elements 420 at the back end 430. For example, the fixed distance 450 at the front end 430 can be wide enough to encircle a handrail 240 and the fixed distance 450 at the back end 440 can be wide enough to encircle a chair frame 260.

The appropriate length of the fixed distance 450 with respect to the circumference or perimeter of the handrails 240 and the chair frame 260 allows the side wall cloth system 400 to be tightly wrapped around the handrails 240 and the chair frame 260. This is aesthetically pleasing for the cloth to be pulled appropriately taut by between the handrails 240 and the chair frame 260. Additionally, the side wall cloth system 400 will not fall off for being too loose.

The adhesive elements 420 can be affixed on opposite sides of the side wall cloth system 400 so that when the side wall cloth system 400 has an end wrapped around an element of the chair, the adhesive elements 420 will be configured to face each other. For example, one adhesive element 420 can be affixed to an internal side of the side wall cloth system 400 and another adhesive element 420 can be affixed to an external side of the side wall cloth system 400. The internal adhesive element 420 and the external adhesive element 420 can be parallel to each other to allow ease of attachment to each other. The adhesive elements 420 can be sewn into the side wall cloth system 400.

The adhesive elements 420 can be a sticker element, Velcro, zipper, snaps, hooks, tying elements, or any other mechanism configured to secure the side wall cloth to itself when wrapped around a chair element.

Therefore, the side wall cloth system 400 can be attached or removed from the armchair system 200 according to the user's preferences. Additionally, users can even have a variety of side wall cloth systems 400 for a single armchair system 200. The variety of side wall cloth systems 400 can include a variety of woven cloth 410 textures and colors to meet the personalized needs of consumers. The side wall cloth systems 400 can additionally be easily removed for cleaning purposes. This variety and flexibility of armchair modification does not exist currently.

While various examples of the present invention have been described above, it should be understood that they have been presented by way of example only, and not limitation. Numerous changes to the disclosed examples can be made in accordance with the disclosure herein without departing from the spirit or scope of the invention. Thus, the breadth and scope of the present invention should not be limited by any of the above described examples. Rather, the scope of the invention should be defined in accordance with the following claims and their equivalents.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application.

The terminology used herein is for the purpose of describing particular examples only and is not intended to be limiting of the invention. As used herein, the singular forms "a", "an" and "the" are intended to include the plural forms as well, unless the context clearly indicates otherwise. Furthermore, to the extent that the terms "including", "includes", "having", "has", "with", or variants thereof are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The invention claimed is:

1. A chair system, comprising:

a chair frame including a rectangular chair seat;

a chair back connected to the chair frame and the rectangular chair seat;

four chair feet connected beneath the chair frame, wherein the chair feet are connected to corners of the rectangular chair seat;

two handrails connected to the chair back and connected to the rectangular chair seat, wherein each handrail is connected to an adjacent side of the chair back and rectangular chair seat and is opposite from the other handrail in the chair system; and two separate and distinct side wall cloths, each side wall cloth being configured to attach to and detach from a respective handrail of the two handrails and a respective portion of the chair frame, wherein:

each side wall cloth includes a first free end with a first internal adhesive element on an internal side of the side wall cloth and a first external adhesive element on an external side of the side wall cloth, and a second free end with a second internal adhesive element on the internal side of the side wall cloth and a second external adhesive element on the external side of the side wall cloth, and each side wall cloth is configured so that the first free end wraps around the respective handrail such that the first internal adhesive element detachably secures to the first external adhesive element and the second free end wraps around the respective portion of the chair frame such that the second internal adhesive element detachably secures to the second external adhesive element.

2. The chair system of claim 1, wherein the two handrails are cylindrical or cuboid elements having a perimeter of a set distance.

3. The chair system of claim 2, wherein the chair frame is a cylindrical or cuboid element having a perimeter substantially the same as the perimeter of the two handrails.

4. The chair system of claim 3, wherein the first internal adhesive element and the first external adhesive element are separated by a distance along a length of the side wall cloth corresponding to the perimeter of the handrail and the second internal adhesive element and the second external adhesive element are separated by a distance along the length of the side wall cloth corresponding to the perimeter of the portion of the chair frame.

5. The chair system of claim 1, wherein the first and second internal adhesive elements and the first and second external adhesive elements can be a hook-and-loop fastener, sticker element, Velcro, zipper, snaps, hooks, or tying elements.

* * * * *